United States Patent [19]

Ginn et al.

[11] 3,934,795

[45] Jan. 27, 1976

[54] DUAL DUCT VARIABLE VOLUME AIR CONDITIONING SYSTEM

[75] Inventors: Le Roy Ginn; Le Royce Ginn, both of San Leandro; Dalny Travaglio, Kensington, all of Calif.

[73] Assignee: Universal Pneumatic Controls, Inc., Oakland, Calif.

[22] Filed: Feb. 1, 1974

[21] Appl. No.: 438,591

[52] U.S. Cl. ..... 236/13; 165/27; 236/80

[51] Int. Cl.[2] ..... F24F 13/04

[58] Field of Search ..... 236/13, 49, 1 C, 1 B, 80; 165/26, 27

[56] References Cited

UNITED STATES PATENTS

| | | | |
|---|---|---|---|
| 3,237,860 | 3/1966 | Jentoft | 236/1 C |
| 3,368,752 | 2/1968 | Marshall et al. | 236/1 C |

*Primary Examiner*—William E. Wayner
*Attorney, Agent, or Firm*—Owen, Wickersham & Erickson

[57] ABSTRACT

A dual duct variable volume air conditioning system has a first, cold duct for supplying cold air and a second, reset duct for supplying either hot air in a first mode of operation or cold air in a second mode of operation. A self-contained system regulator positions first and second valves in the first and second ducts in response to changes in room temperature. The regulator is effective to reverse the direction of response of the second valve to temperature in the second mode of operation from the direction of response of that valve to a similar temperature change in the first mode of operation so that the reset duct can be used as a hot duct with the system supplying warm or cold air on demand in the heating season (without mixing) and as a cold duct to double the cooling capacity of the system in the cooling season. The system includes an integrated sensor-actuator for each air flow duct having a diaphragm which both senses the flow velocity in the duct and positions the valve in the duct through a direct mechanical connection. The actuator moves the valve with changes in flow velocity using the pressures in the duct without a relay.

31 Claims, 21 Drawing Figures

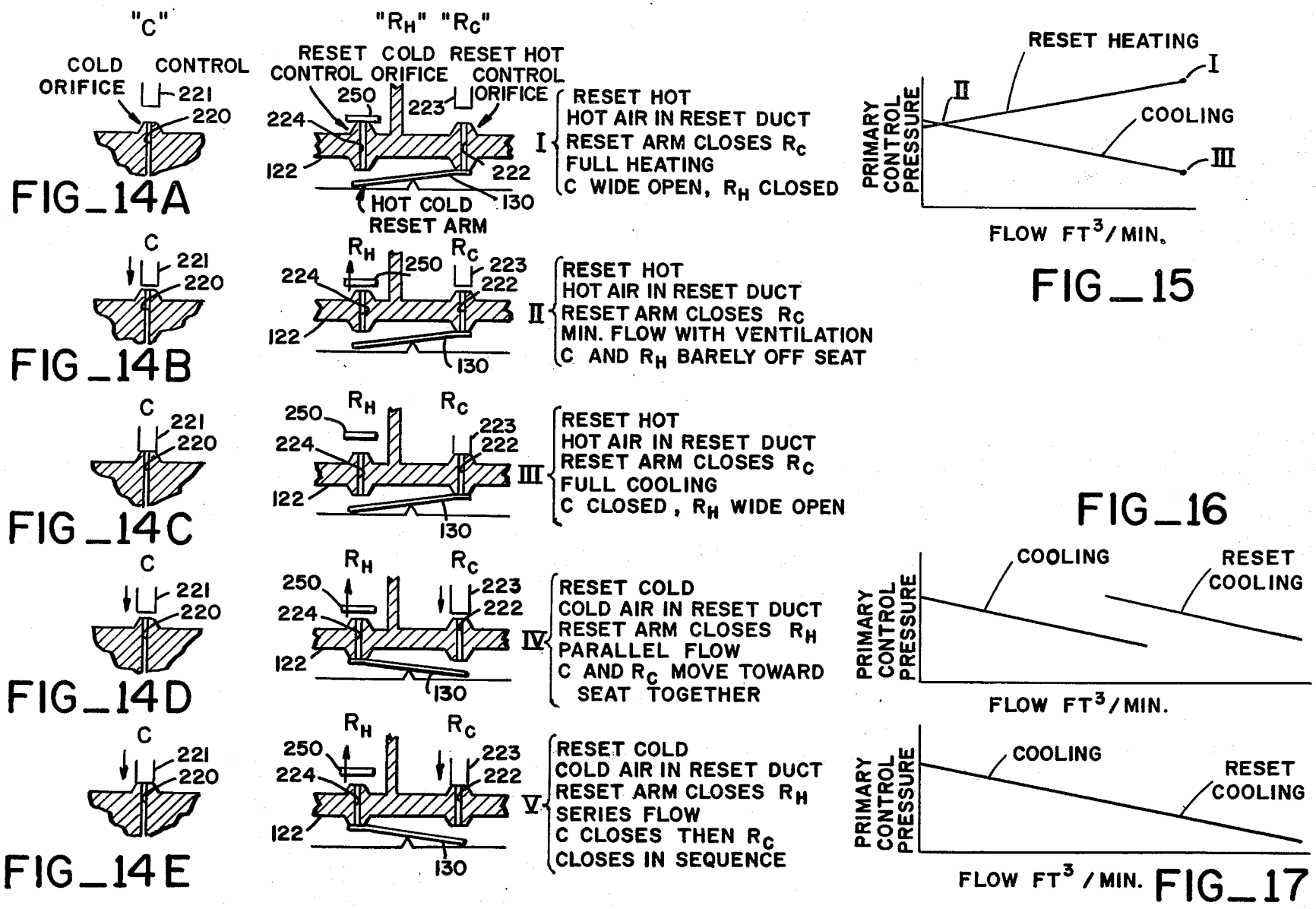
"C"
COLD ORIFICE
CONTROL
221
220
FIG_14A
C
221
220
FIG_14B
C
221
220
FIG_14C
C
221
220
FIG_14D
C
221
220
FIG_14E
"$R_H$" "$R_C$"
RESET COLD CONTROL ORIFICE
RESET HOT CONTROL ORIFICE
223
250
224
122
222
130
HOT COLD RESET ARM
I
RESET HOT
HOT AIR IN RESET DUCT
RESET ARM CLOSES $R_C$
FULL HEATING
C WIDE OPEN, $R_H$ CLOSED
$R_C$
$R_H$
II
RESET HOT
HOT AIR IN RESET DUCT
RESET ARM CLOSES $R_C$
MIN. FLOW WITH VENTILATION
C AND $R_H$ BARELY OFF SEAT
III
RESET HOT
HOT AIR IN RESET DUCT
RESET ARM CLOSES $R_C$
FULL COOLING
C CLOSED, $R_H$ WIDE OPEN
IV
RESET COLD
COLD AIR IN RESET DUCT
RESET ARM CLOSES $R_H$
PARALLEL FLOW
C AND $R_C$ MOVE TOWARD SEAT TOGETHER
V
RESET COLD
COLD AIR IN RESET DUCT
RESET ARM CLOSES $R_H$
SERIES FLOW
C CLOSES THEN $R_C$
CLOSES IN SEQUENCE
PRIMARY CONTROL PRESSURE
RESET HEATING
COOLING
FLOW $FT^3$/MIN.
FIG_15
COOLING
RESET COOLING
FIG_16
FIG_17

DUAL DUCT VARIABLE VOLUME AIR CONDITIONING SYSTEM

BACKGROUND OF THE INVENTION

This invention relates to a conditioned air distribution system of the kind having an air flow duct and a valve in the duct for regulating the volume flow of air through the duct.

This invention relates particularly to an air distribution system of this kind in which the valve is positioned by a pneumatically powered motor.

Systems of this kind are often constant velocity systems but are usually subject to variation in the velocity flow depending upon changes in the room air temperature. The constant velocity regulation has been obtained by sensing the difference between static pressure and total pressure in the duct. However, regulation of the velocity flow in the prior art has been by means of relay mechanisms which introduce unwanted complexity and expense.

It is an important object in the present invention to achieve regulation of the velocity flow by an integrated sensor-actuator. The actuator has a diaphragm which both senses velocity flow and positions a valve in the duct by a direct mechanical connection using the pressures in the duct without a relay.

In many installations the conditioned air distribution system must be able to supply both hot air for heating and cold air for cooling.

Dual duct systems for hot and cold air have been controlled in a way to blend or to mix the hot air flow with the cold air flow to produce the desired amount of cooling or the desired amount of heating. This blending is inefficient because the hot air and the cold air are necessarily fighting against each other. There is a waste of the energy used to produce the hot air and the cold air.

It is an important object of the present invention to control the air flow from a dual duct system in a way such that (when the reset duct is used as a hot duct) conditioned air is supplied from only one of the hot and cold ducts at a time without mixing with air from the other duct, except for a possible small overlap required to maintain ventilation requirements.

SUMMARY OF THE PRESENT INVENTION

A conditioned air distribution system constructed in accordance with the present invention comprises a first, cold duct for supplying cold air, a first valve in the first, cold duct for regulating the volume of air flowing through the duct, a second, reset duct for supplying either hot air in a first mode of operation or cold air in a second mode of operation, and a second valve in a second, reset duct for regulating the volume of air flowing through the duct. A self-contained or pneumatic powered system regulator positions the first and second valves in response to temperature in the room. The regulator is effective to reverse the direction of response of the second valve to temperature change in the second mode of operation from the direction of response of that valve to a similar temperature change in the first mode of operation. This permits the reset duct to be used as a hot duct with the system supplying hot or cold air on demand in the heating season and as a cold duct to double the cooling capacity of the system in the cooling season.

When the reset duct is used as a hot duct, the self-contained system regulator is effective to position the valves in the ducts in response to the temperature in a room in a way which is effective to supply conditioned air from only one of the ducts at a time without mixing with air from the other duct, except for a possible small overlap required to maintain minimum ventilation requirements.

The control valve for each duct is positioned by a pneumatically powered actuator. The actuator is an integrated sensor-actuator which has a diaphragm which senses the flow velocity in the duct and which is also connected to the valve by a direct mechanical connection. The diaphragm moves the valve with changes in the flow velocity using the pressures in the duct without a relay.

Conditioned air distribution system apparatus and methods which incorporate the structures and techniques described above and which are effective to function as described above constitute specific objects of this invention.

Other objects, advantages and features of the invention will become readily apparent from the following detailed description of one embodiment which is presented in conjunction with the accompanying drawings.

BRIEF DESCRIPTION OF THE DRAWINGS

In the drawings:

FIG. 1 shows how a dual duct variable volume air conditioning system constructed in accordance with one embodiment of the present invention is used in the building perimeter. FIG. 1 also shows how an integrated sensor-actuator constructed in accordance with another embodiment of the present invention is used with a single cold air duct for the building interior.

FIGS. 14A through 14E are schematic views illustrating the control and operation of the three control orifices (cold control orifice, the reset hot control orifice, and the reset cold control orifice) of the self-contained system regulator for the various conditions of operation of the dual duct variable volume air conditioning system noted in the legends of these FIGS.

FIG. 15 is a graph showing the operation of the dual duct variable volume air conditioning system under the control of the self-contained system regulator. In FIG. 15 the flow in cubic feet per minute is plotted against primary control pressure. The points indicated by Roman numerals I, II and III correspond to the conditions of operation indicated by these Roman numerals in FIGS. 14A, 14B and 14C respectively.

FIG. 16 is a graph in which flow in cubic feet per minute is plotted against primary control pressure and illustrates the condition of operation indicated in FIG. 14D in which the reset duct conducts cold air, and in which the series or parallel reset adjustment is set for parallel flow with the cold duct.

FIG. 17 is a graph in which flow in cubic feet per minute is plotted against primary control pressure and illustrates the condition of operation shown in FIG. 14E in which the reset duct conducts cold air and the series or parallel reset adjustment is set for series flow with the cold duct.

DESCRIPTION OF THE PREFERRED EMBODIMENTS

Figure 1:
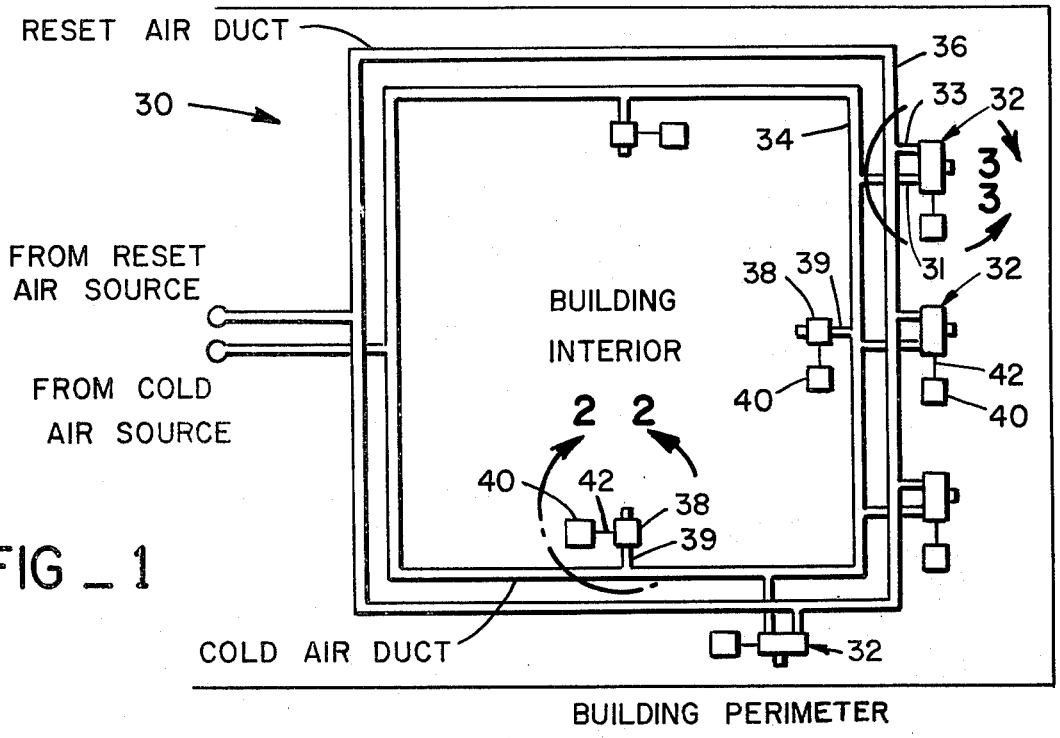
FIG. 1 is a schematic plan view of a building interior.

An air distribution system constructed in accordance with one embodiment of the present invention is shown in a schematic plan view in FIG. 1 and is indicated generally by the reference number 30.

In the system 30 shown in FIG. 1 the building perimeter is supplied with conditioned air from a dual duct system in which each volume regulating box 32 is connected to both a cold air duct 34 and a reset air duct 36. Each volume regulator box 32 is connected to the cold duct 34 by a branch take off duct 31 and to the reset duct 36 by a branch take off line 33.

As will be described in greater detail below, the reset air duct 36 can supply either hot air or cold air, depending upon the need.

As illustrated in FIG. 1, the building interior is supplied only with cold air from the cold air duct 34.

The flow of cold air to the building interior is controlled by a number of volume regulator boxes 38 which are connected to the cold duct 34 by a branch take off duct 39 as illustrated.

As will be described in greater detail below, the volume flow through each volume control box 32 and 38 is controlled by a pneumatic thermostat 40 which senses room temperature and which is connected by a bleed line 42 either directly to an integrated sensor-actuator for the valve in each volume regulator box 38 or to a self-contained system regulator which controls the actions of the actuators for the valves in each volume regulator box 32.

The system 30 shown in FIG. 1 has general application to a large number of buildings used in varied geographic locations. It is particularly well suited to buildings having a considerable amount of glass on the periphery and relatively sensitive to solar heat loads and also heat losses by conduction, convection and direct radiation.

In many office and residential buildings the heat generated by lighting and by people within the building is more than sufficient to maintain the temperatures in the building interior at or above the desired levels. In such buildings only cooling and ventilation are required for the building interior.

The building perimeter, however, is subjected to greater temperature fluctuations (for the reasons noted above) and may therefore require heating (rather than cooling) during one season and may require greater cooling than obtainable from a single cold duct during another season.

The present invention provides a reset air duct which can supply either hot air or cold air. It also provides a method of control (described in greater detail below) which permits the air in the reset duct (whether hot or cold) to be regulated in coordination with the air in the cold duct in accordance with system demand.

The present invention provides a novel integrated sensor-actuator for positioning each flow control valve in each volume regulator box. This integrated sensor-actuator uses a diaphragm which serves both to sense the flow velocity in the duct and also to move the valve with changes in flow velocity. It uses the pressures in the duct without a relay.

Figure 2:
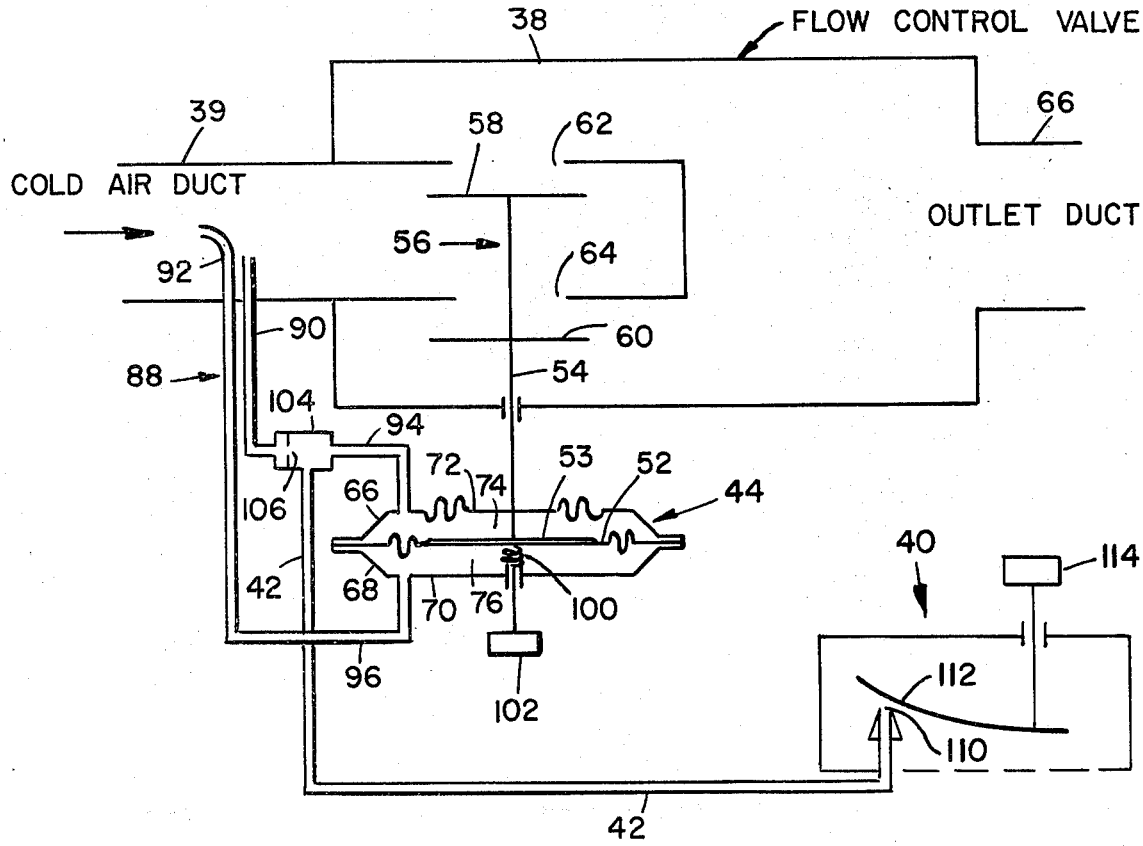
FIG. 2 is a schematic side elevation view (of the part of the structure shown encircled by the arrows 2—2 in FIG. 1) showing an integrated sensor-actuator for the duct flow control constructed in accordance with one embodiment of the present invention.

As illustrated in FIG. 2, each volume regulator box 38 for the building interior uses only a single integrated sensor-actuator (indicated generally by the reference numeral 44).

Figure 3:
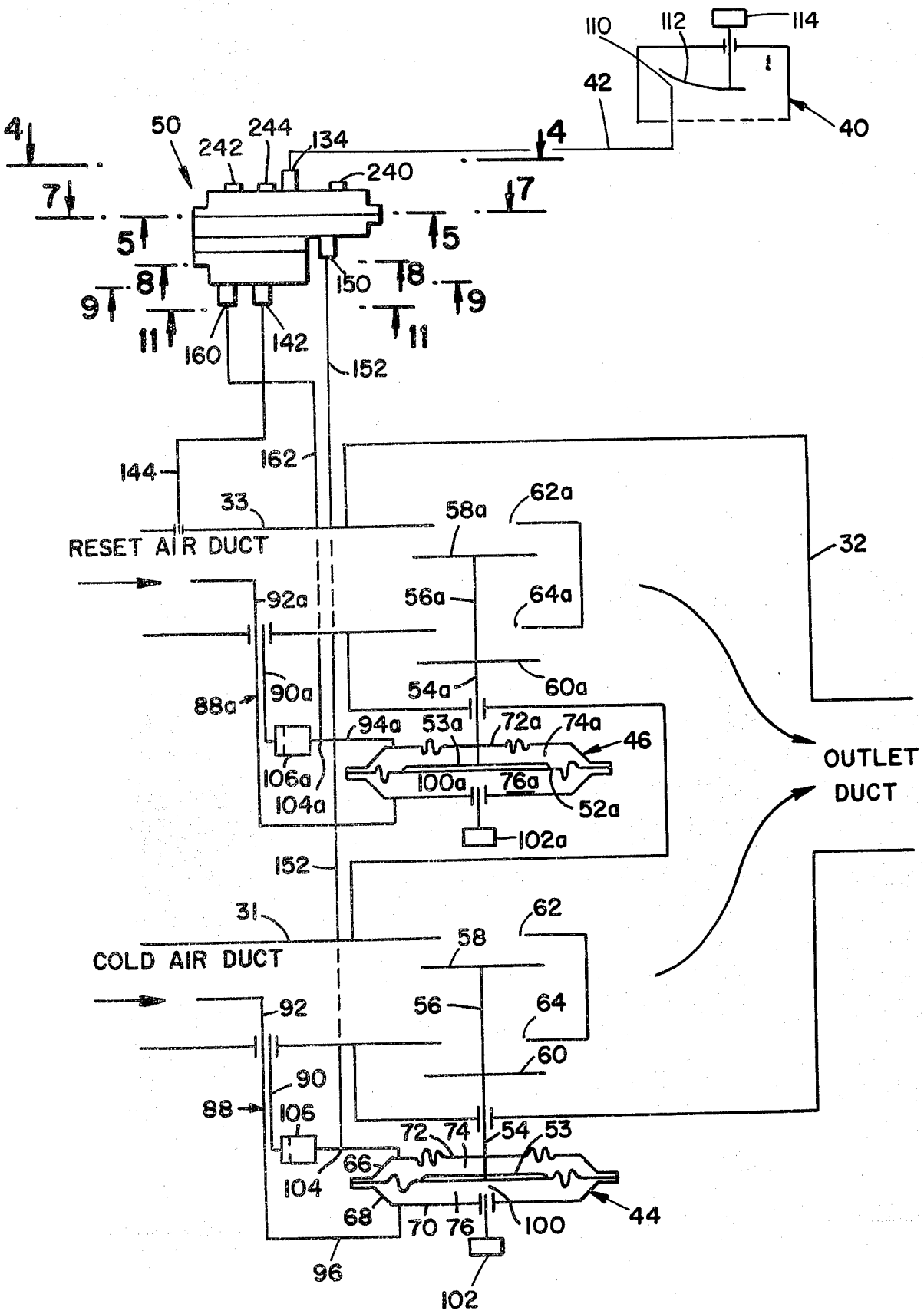
FIG. 3 is a schematic side elevation view (of the part of the structure shown encircled by the arrows 3—3 in FIG. 1) showing how a self-contained system regulator constructed in accordance with an embodiment of the present invention is associated with two integrated sensor-actuators for controlling the flow through a cold air duct and through a reset air duct which may contain either warm air or cold air.
Figure 4:
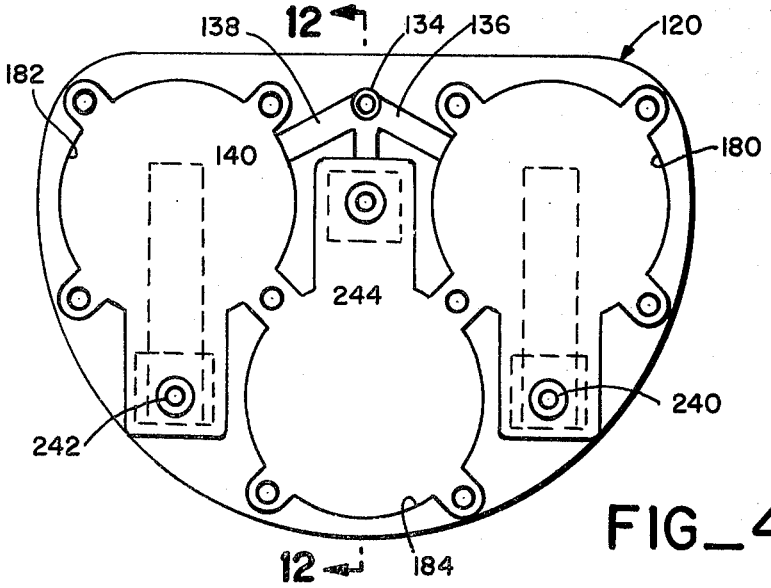
FIG. 4 is a top plan view of the outside of a cover of the self-contained system regulator and is taken along the line and in the direction indicated by the arrows 4—4 in FIG. 3 and FIG. 13.

As illustrated in FIG. 3, each volume regulator box 32 for the dual duct system uses two such integrated sensor-actuators, a sensor-actuator 44 for controlling the air flow from the cold air duct and an integrated sensor-actuator 46 for controlling the air flow from the reset air duct.

The dual duct system shown in FIG. 3 utilizes a self-contained system regulator 50 which coordinates the response of the integrated sensor-actuators 44 and 46 to the temperature sensed by the thermostat 40.

This self-contained system regulator 50 is effective to coordinate the responses in a way such that the volume regulator box 32 supplies conditioned air from only one of the cold air duct 31 and reset air duct 33 when the reset air duct 33 supplies warm air. That is, when the reset duct is a hot duct, the self-contained system regulator control is effective to supply conditioned air from only one of the ducts at a time without mixing the air from the other duct, except for a possible small overlap required to maintain minimum ventilation requirements.

The regulator 50 also coordinates the flow of air from the cold air duct 31 with the flow of air from the reset air duct 33 when the reset air duct supplies cold air in a way such that the increased cooling from the reset air duct 33 is supplied either in series or in parallel with the flow of air from the cold air duct 31.

The construction and mode of operation of the self-contained system regulator 50 which provides this coordination will be described in detail below with reference to FIGS. 4-17.

However, before going into this description of the regulator 50, the details of the construction and mode of operation of the integrated sensor-actuator 44 will be described with reference to FIG. 2.

As shown in FIG. 2 the integrated sensor-actuator 44 comprises a sensor-actuator diaphragm 52 which is connected, by a connecting rod 54, to a balanced valve spool 56 having an upper disc 58 and a lower disc 60. The upper disc 58 regulates the flow of air from the interior of the cold air duct 39 through an upper opening 62. The lower disc 60 controls the flow of air from the interior of the cold duct 39 through a lower opening 64. The air flowing out of the openings 62 and 64 in the cold air duct 39 flows into the interior of the volume regulator box 38. It flows out of the volume regulator box through an outlet opening 66 into the room.

All of the flow of cold air through the volume regulator box 38 must either go over the top flow disc 58 and out the opening 62 or out the round opening 64 and over the bottom disc 60.

Because the areas of the top flow disc 58 and the bottom flow disc 60 are equal and the areas of the top opening 62 and the bottom opening 64 are equal, the pressure drops are equal across both flow discs 58 and 60 and both round openings 62 and 64. This combination of parts produces a balanced valve. One advantage of a balanced valve type of metering construction is the small force required to move it from full open to closed flow of air. The present invention takes full advantage of this feature.

In accordance with the present invention, the diaphragm 52 of the integrated sensor-actuator 44 is directly connected to the valve spool 56 by the connecting rod 54 so that any upward or downward movement of the diaphragm 52 produces a corresponding amount of movement of the valve spool 56.

The diaphragm 52 is mounted within a module having side walls 66 and 68, a bottom wall 70 and an upper, isolation seal diaphragm 72.

This construction provides an enclosed upper chamber 74 and an enclosed lower chamber 76.

The bottom wall 70 and the isolation seal diaphragm 72 isolate the effect of atmospheric pressure on the pressures within the chambers 74 and 76.

As can be seen by reference to FIG. 2, the pressure in chamber 74 tends to move the valve in an opening direction while the pressure in the chamber 76 tends to move the valve 56 in a closing direction.

A metal piston plate 53 is connected to the flexible diaphragm 52 and the connecting rod 54 to provide increased rigidity in the central part of the diaphragm and to thereby provide uniform movement of the valve spool 56 with pressure changes in the actuator.

The pressures in the chambers 74 and 76 are supplied by a pitot tube sensor 88 having a static pressure probe 90 and a total pressure probe 92 located in the duct 39. The total pressure probe 92 is oriented to pick up the impact pressure of the air flowing in the direction indicated by the arrow in FIG. 2.

The static pressure is conducted to the chamber 74 through a conduit 94, and the total pressure is conducted to the chamber 76 through a conduit 96.

Since the total pressure probe 92 picks up both velocity pressure and static pressure in the duct, the difference between the pressures sensed by the probes 92 and 90 is the velocity pressure of the air flow stream in the cold air duct 39. This velocity pressure is a direct indication of the velocity of air in the duct 39. The differential between the total pressure and the static pressure (which gives this velocity pressure) is applied to the valve sensing and drive diaphragm 52 to exert a force on the diaphragm 52 in a direction tending to close the valve 56.

As noted above, the differential between the impact pressure and the static pressure (which may be in the order of several tenths of an inch of a water column under normal static and velocity pressures of the air flow within the branch take off duct 39) is applied across the area of the diaphragm 52 to produce an upwardly directed force on the connecting rod 54 tending to close the valve 56.

The desired volume flow through the balanced valve 56 can then be selected by biasing the valve toward an open position with a selected amount of force.

In the form of the invention illustrated in FIG. 2 this bias is exerted by a tension spring 100. The amount of tension exerted by the tension spring 100 is adjusted by a control knob 102 threaded within the bottom wall 70 of the actuator 44.

Other biasing means can also be used. For example, a series of balancing weights can be placed on top of the upper valve disc 58 to operate in the desired ranges. These weights can be color-coded so that a blue weight will indicate a range of so many pounds to so many pounds, a red weight will indicate a different range, and so forth.

The biasing arrangements thus far described have been described for use with a relatively light weight valve so that the differential pressure has to act against the spring as well as the weight of the valve to open the valve.

This arrangement is useful in relatively small constructions where the valve does not weight very much.

In large installations in which the valve is relatively heavy, it may be necessary to put a spring on top of the valve to act with the differential pressure.

Another arrangement is to use a compression spring on the bottom rather than a tension spring when the valve unit becomes relatively large and heavy. This also permits using weights on top of the valve in combination with the compression spring.

The basic idea is to bias the valve, and this can be done either by a spring alone in certain situations or springs plus weights in other situations.

In any event the biasing force is used to control velocity flow by imposing the biasing force in opposition to the force produced by the differential between the static and impact pressures (which is the velocity pressure as described above) acting across the area of the valve sensing and drive diaphragm 52.

As thus far described, the integrated sensor-actuator 44 provides constant velocity flow control, and it does this using the existing pressures in the duct without a relay.

The thermostat 40 is incorporated with the integrated sensor-actuator 44 to provide an override on the constant velocity air flow control (sensed and effected by the diaphragm 52) in response to room temperature.

The thermostat 40 acts on the static pressure in the chamber 74 to bleed off a certain amount of the pressure in chamber 74 (through the bleed line 42) when the room temperature drops below the set point of the thermostat.

The thermostatic control 40 includes a T-joint connection 104 in the conduit 94 having an orifice 106 and a connection downstream of the orifice to the bleed line 42.

A bleed nozzle 110 is located at the end of bleed conduit 42, and the bleed flow through the nozzle 110 is controlled by a bimetal strip 112.

An adjustable knob 114 sets the bias on the bimetal strip 114 to produce the desired temperature set point.

When the room temperature drops below the setting of the bimetal strip 112, the strip 112 bends away from the bleed nozzle 110 to permit flow through the nozzle. Since the nozzle 110 has a substantially larger diameter than the diameter of the orifice 106, uncovering the bleed nozzle 110 reduces the pressure in the chamber 74.

To further explain the operation of the system described above, let us assume a typical volume regulator box required to deliver a maximum of 500 cu. ft. per minute (C.F.M.) from a 6 inch round duct to a room and to maintain room temperature as set on the thermostat 40.

With a minimum of 1 inch water column static pressure in the duct 39 to meet the maximum requirement of 500 C.F.M., the duct air would have to travel at 2,550 feet per minute through the 6 inch round duct 39. This would give a velocity pressure difference of 0.4 inch water column between the static pressure tube 90 and the total pressure tube 92. The static pressure is still 1 inch, but the impact pressure has increased to 1.4 inch water column. The impact pressure (1.4 inch water column) is present in chamber 76 and, assuming the bleed nozzle 110 in the room thermostat 40 is closed, then the static pressure 1 inch water column would be present in chamber 74.

The pressure difference between the chambers 76 and 74 across the diaphragm 52 would be the velocity pressure 0.4 inch water column.

The force exerted on the piston disc 53 by the sensing diaphragm 52 would be the velocity pressure 0.4 inch water column minus the force of the velocity spring 100 which is connected to the rod 54.

The force applied to the velocity spring 100 by the velocity set screw 102, should be 0.4 inch water column because that is the desired velocity pressure.

When an increase of air flow results from an increased static pressure in the duct 39, the velocity pressure will increase above 0.4 inch water column. The increase in velocity pressure will permit the sensing diaphragm 52 to overcome the 0.4 inch water column of force of the velocity spring 100 and raise the piston disc 54. As the piston disc 54 raises, the rod 54 moves the flow discs 60 and 58 near the round openings 64 and 62, thus reducing the air flow which results in a lower velocity pressure; and a point of equilibrium is reached.

It can be seen by the above explanation that this combination of structure and operation can maintain a maximum limit on the C.F.M. of cool air through the volume regulator box 38.

In the above explanation the thermostat bimetal strip 112 sealed off the bleed nozzle 110, because the room was warmer than the thermostat set point. The 500 C.F.M. of cool air coming into the room from the volume regulator box 38 would lower the room temperature below the thermostat set point and the bimetal strip 112 would open the bleed nozzle 110.

The orifice 106, as described above, is smaller than the bleed nozzle 110 so that the air in the line 42 and the chamber 74 would be bled off to atmosphere until the pressure would be equal to atmospheric pressure.

The total pressure in line 96 and the chamber 76 is the static pressure 1 inch water column plus any impact pressure and is sensed across sensing diaphragm 52 to chamber 74 which is at atmospheric pressure. The 1 inch water column plus the impact pressure overcomes the velocity spring 100 and raises the piston disc 53 and the flow discs 60 and 58 to shut off the flow of cool air through the round openings 64 and 62.

There will then be no air flow through the volume regulator box 38 until the room temperature raises above the temperature set point of the thermostat 40 and the bimetal strip 112 seals off the bleed nozzle 110.

The above description of a two position or on-off operation of the thermostat 40 was made only to simplify the explanation. In an actual system the air flow responds to movement of the bimetal strip 112 over the bleed nozzle 110 in a modulating manner. When the room becomes a little warm, there is an increase in the flow of cool air to maintain an even room temperature.

While the construction and mode of operation of the integrated sensor-actuator 44 shown in FIG. 2 has been described with specific reference to the control of air flow through a cold duct, it should be recognized that this integrated sensor-actuator can equally well be used to control air flow through a hot air duct used for heating. In this event, the action of the thermostat 40 needs to be reversed so that lower temperatures (rather than higher temperatures) cause a greater opening of the valve element 56.

As noted above, the reset air duct 33 of the dual duct system shown in FIG. 3 can contain either hot air or cold air. This system therefore can be operated in five different distinct ways.

When the reset air duct 33 contains hot air full heating may be required (as indicated in the legend in FIG. 14A). In this event the valve in the cold air duct 31 is positioned to close off all flow of air through the cold air duct until the hot air supplied through the reset duct 33 brings the room temperature up to the desired level as determined by the set point of the thermostat 40.

With the reset air duct operating as the hot duct, the room temperature may be enough above the set point of the thermostat 40 so that full cooling is required. In this event the actuator 46 closes the valve in the reset hot duct 33 so that only cold air from the cold air duct 31 flows out of the volume regulator box 32. This is the condition illustrated in FIG. 14C.

With the reset duct 33 operating as a reset hot duct, the room temperature may be right on or very close to the set point of the thermostat 40 so that only a minimum flow to meet ventilation requirements is desired out of the volume regulator box 32. This corresponds to the condition indicated by the legend in FIG. 14B. In this case (in contrast to the heating or cooling flow conditions noted above) it may be necessary to permit some mixing of the flow out of the reset hot duct and the cold duct. Except for such a small overlap required to maintain minimum ventilation requirements, the self-contained system regulator 50 signals the integrated sensor-actuators 44 and 46 to supply flow from only one of the ducts 31 and 33 at any one time. This prevents inefficient mixing when the reset duct 33 is used as a reset hot duct.

When the rest duct 33 is used as a cold duct (to provide increased cooling over and above that which can be provided by the cold duct 31 alone) the fourth and fifth conditions of operation noted above can be obtained from the adjustments which can be set on the self-contained regulator 50.

The reset cold duct 33 can be operated to provide cold air flow in series with the cold air duct 31. This is the fourth condition noted above and is indicated by the legend in FIG. 14E.

The reset cold duct can also be operated to provide cold air flow in parallel with the air flow from the cold duct 31. This is the fifth condition of operation and is indicated by the legend in FIG. 14D.

The adjustable settings on the self-contained system regulator are such that the series and the parallel flow can be made to overlap to any desired degree, as will become more apparent from the detailed description of the construction and mode of operation of the regulator 50 below.

Figure 12:
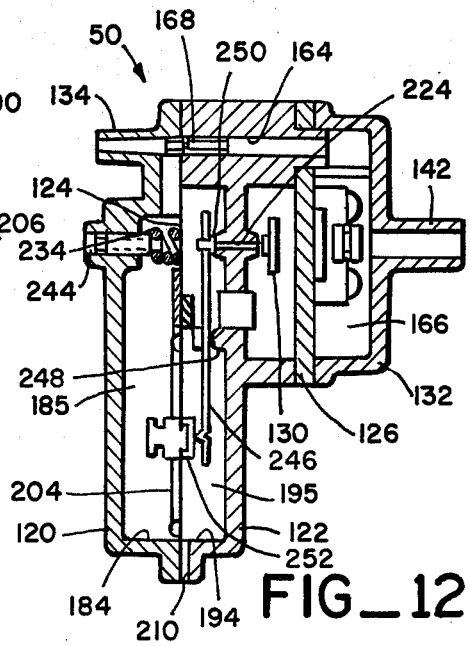
FIG. 12 is an end elevation view in cross section through the self-contained system regulator and is taken along the line and in the direction indicated by the arrows 12—12 in FIG. 4, FIG. 7 and FIG. 11, and FIG. 9.
Figure 13:
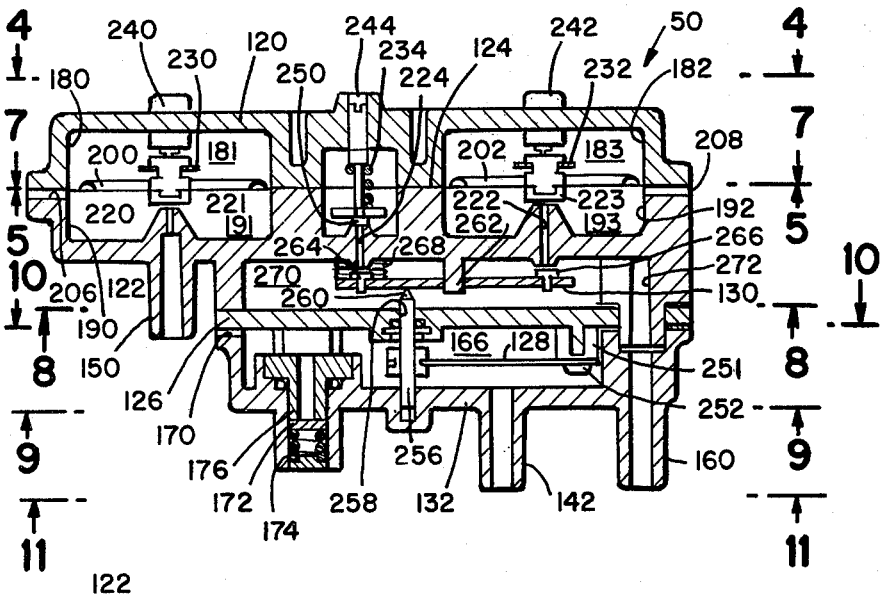
FIG. 13 is a side elevation view in cross section through the self-contained system regulator and is taken along the line and in the direction indicated by arrows 13—13 in FIG. 5, FIG. 8 and FIG. 9, and FIG. 11.
Figure 8:
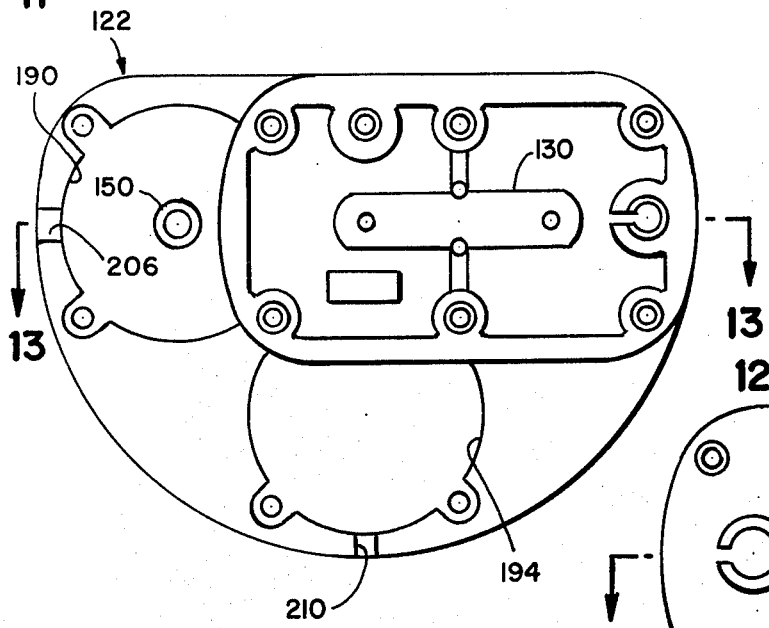
FIG. 8 is a plan view of the base of the self-contained system regulator and is taken along the line and in the direction indicated by the arrows 8—8 in FIG. 3 and in FIG. 13.
Figure 9:
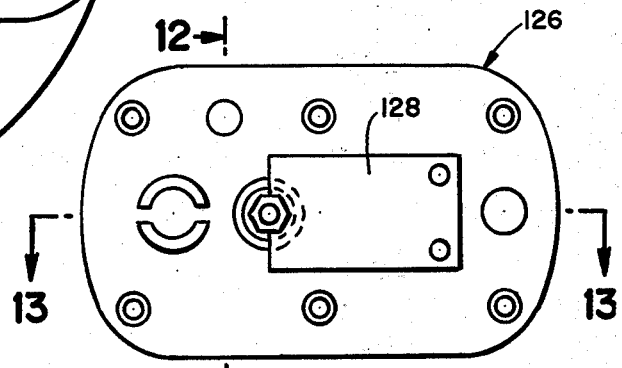
FIG. 9 is a plan view of a bimetal deck of the self-contained system regulator and is taken along the line and in the direction indicated by the arrows 9—9 in FIG. 3 and FIG. 13.
Figure 10:
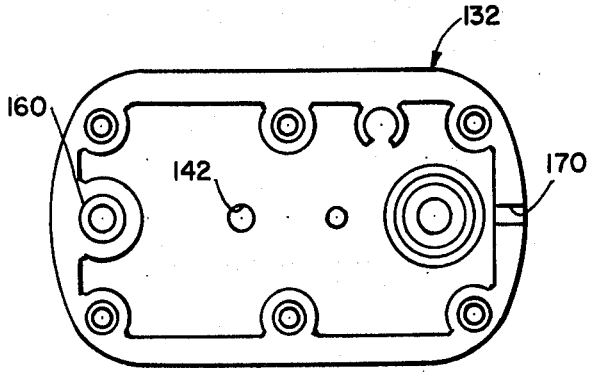
FIG. 10 is a plan view of the inside of the bimetal cover of the self-contained system regulator and is taken along the line and in the direction indicated by the arrows 10—10 in FIG. 13.
Figure 11:
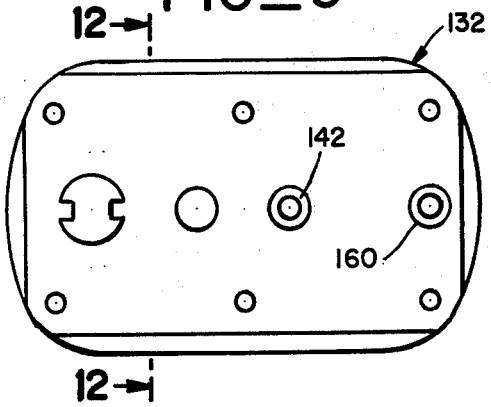
FIG. 11 is a plan view of the outside of the bimetal cover shown in FIG. 10 and is taken along the line and in the direction indicated by the arrows 11—11 in FIG. 3 and FIG. 13.

As best illustrated in the cross section views of FIGS. 12 and 13, the self-contained system regulator 50 comprises a cover 120, a base 122, a diaphragm 124 captured between the cover 120 and the base 122, a bimetal deck 126, a bimetal 128, a hot-cold reset arm 130, and a bimetal cover 132.

In FIG. 3 the construction and mode of operation of the integrated sensor-actuator 46 for the reset air duct 33 is the same as the actuator 44 for the cold air duct 31, and the same reference numerals have therefore been used for the actuator 46 as for the actuator 44 except for the addition of the letter *a* after each reference numeral for the actuator 46.

In the system shown in FIG. 3 the lead line 42 from the thermostat 40 is connected to the self-contained system regulator 50 at a fitting 134 on the cover (see FIGS. 3 and 12). The pressure of this primary control air to the thermostat is distributed equally above the top of the diapphragm 124 by channels 136, 138 and 140 formed in the cover and illustrated in FIGS. 4 and 5.

With continued reference to FIG. 3, a fitting 142 on the bimetal cover 132 serves as a reset duct temperature sensing connection for sensing the temperature of the air in the reset duct 33. The temperature of the air in the reset duct is transmitted by a conduit 144 to the regulator 50 and through the fitting 142. The temperature of the air acts on the bimetal 128 to cause a switching function by the bimetal 128 when the reset duct is changed from a hot duct to a cold duct and vice versa. This will be described below in greater detail with reference to FIG. 13.

The self-contained system regulator 50 has two fittings for supplying the control air signals to the integrated sensor-actuators 44 and 46 for the cold air duct and the reset air duct.

Fitting 150 is the cold duct control air outlet and is connected to the Tee 104 in the static pressure line 94 downstream of the restricter 106 by a conduit 152.

Fitting 160 is the reset duct control air fitting and is connected to the Tee joint 104*a* of the static line 94*a* downstream of the restrictor 106*a* by a conduit 162.

In the construction of the regulator 50 illustrated in FIGS. 12 and 13 the primary control air to the thermostat 40 is taken from a passageway 164 (see FIG. 12) which is open at its lower end to the chamber 166 containing the switching bimetal 128 and which is supplied with air at static pressure from the reset air duct by the reset temperature sensing fitting 142.

A restrictor 168 having a small diameter orifice (0.070 inch diameter in a specific embodiment of the present invention) is mounted in the channel 164 as illustrated. Since the flow area through the restrictor 168 is considerably smaller than the opening in the nozzle 110 of the thermostat 40 (which opening is 0.020 inch in a specific embodiment of the present invention), variation of the bleed flow out of the thermostat nozzle 110 provides quick response of the pressure above the diaphragm 124 to changes in room temperature.

While air at static pressure from the reset air duct is used as the primary control air as described above, the present invention is not limited to using this particular source of primary controlled air. Any auxiliary source of primary control air could equally well be used as a source of supply to the restrictor 168. Also, while duct air has been shown and described for powering the actuators, standard pneumatic controls for sensing and controlling the velocity of air can be integrated with the system of the present invention.

The bimetal cover 132 has a vent 170 (see FIGS. 10 and 13) for venting the chamber 166.

A pressure relief valve 172 is spring loaded by spring 174 against the bottom of a valve seat 176 (as best illustrated in FIG. 13) to regulate the maximum pressure that can be produced in the chamber 166.

Figure 5:
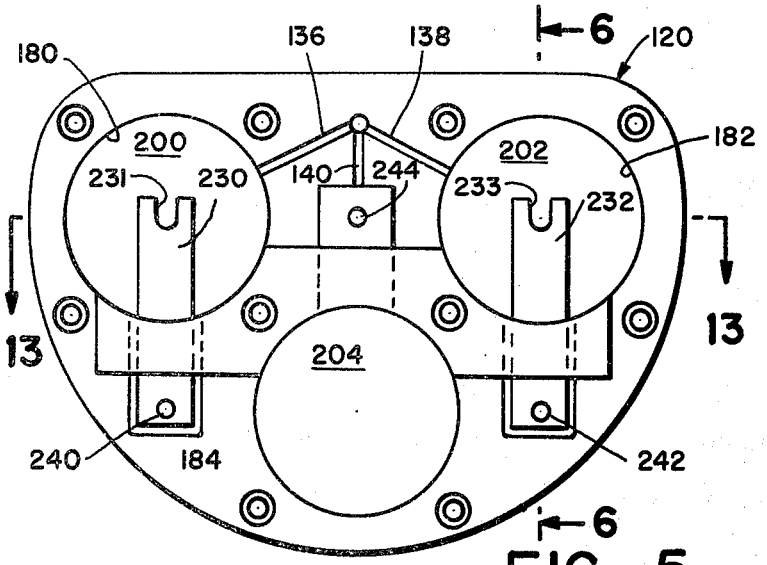
FIG. 5 is a bottom plan view of the inside of the cover shown in FIG. 4 and is taken along the line and in the direction indicated by the arrows 55 in FIG. 3 and FIG. 13.

As best shown in FIG. 5, the cover 122 is formed with three circular shaped, recessed cavities 180, 182, and 184. These three chambers are connected to the primary control air to the thermostat fitting 134 by the passageways 136, 138 and 140 noted above.

The recessed cavities 182 and 184 in the cover coact with similar and aligned, circular shaped, recessed cavities 190, 192 and 194 formed in the base 122 (see FIG. 7) to capture the diaphragm 122 in three separate and distinct areas. This provides the three separate diaphragms 200, 202 and 204 thus shown in the side elevation in the cross sectional views of FIG. 13 and FIG. 12 and also indicated in the plan views of FIG. 5 and FIG. 7.

As best illustrated in the cross section views of FIG. 13 and FIG. 12, the diaphragm 200 thus has a chamber 181 above the diaphragm and a chamber 191 below the diaphragm; the diaphragm 202 has a chamber 183 above the diaphragm and a chamber 193 below the diaphragm; and the diaphragm 204 has a chamber 185 above the diaphragm and a chamber 195 below the diaphragm.

Each of the upper chambers 181, 183 and 185 are maintained at the same pressure because of the interconnection provided by the channels 136, 138 and 140 with the primary control air to the thermostat fitting 134.

Each lower chamber 191, 193 and 195 is vented to atmosphere by a vent opening formed in the base. See the vent openings 206, 208 and 210 in FIG. 7, FIG. 13 and FIG. 12.

In accordance with the present invention the base 122 is formed with three orifices 220, 222 and 224 which extend through the bottom wall of the base.

The rate of flow through these three orifices and the sequence of flow through these three orifices provide the control for the air flow through the cold air duct 31 and the reset air duct 33 under all conditions of operation.

The orifice 220 serves as the control orifice for the cold duct 31. In this case the diaphragm 200 serves merely as a relay between the thermostat 40 and the bleed line from the Tee connection 104 for variation of the pressure in the chamber 74 of the actuator 44. That is, movement of the bimetal 112 in the FIG. 3 embodiment produces exactly the same movement of the valve 56 of the cold duct 31 in the FIG. 3 embodiment as does the same movement of the bimetal 112 of the thermostat 40 in the FIG. 2 embodiment.

To accomplish the relay action, the diaphragm 200 has a control disc 221 on its lower surface. Movement of this control disc 221 toward and away from the orifice 220 with changes in the pressure in the upper chamber 181 (resulting from movement of the bimetal 112 of the thermostat 40) varies the rate of which the air can flow out of the orifice 120 and therefore varies the bleed-off of pressure through the fitting 150, the conduit 152, the conduit 94 and the upper chamber 74 of the actuator 44. Since the orifice 220 is considerably larger in diameter than the orifice 106 (in the same way that the internal diameter of the nozzle 110 is considerably larger than the internal diameter of the orifice 168), movement of the bimetal 112 in the thermostat 40 is relayed through the diaphragm 200 to effect basically the same control of the actuator 44 in the FIG. 3 embodiment as would be the case in the FIG. 2 embodiment.

It should be noted, however, that the self-contained regulator 50 also contains means for controlling the sequence in which the orifice 220 operates with respect to the other two orifices 222 and 224. In the specific construction as shown in FIGS. 5 and 13 these means include a biasing spring which exerts a biasing force on the diaphragm 202 to vary or to shift the overall response of the diaphragm to room temperature changes.

As will be described in greater detail below, the means for controlling the sequence that the orifice 220 operates with respect to the other two orifices 222 and 224 actually comprise two leaf springs 230 and 232 (see FIG. 5) and a coiled spring 234 (see FIG. 12). These springs are also shown in FIG. 13.

Figure 6:
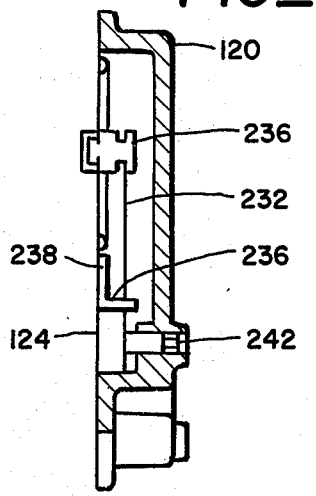
FIG. 6 is an elevation view in cross section taken along the line and in the direction indicated by the arrows 6—6 in FIG. 5 and shows details of the adjustment for changing the sequencing set point for the cold duct.
Figure 7:
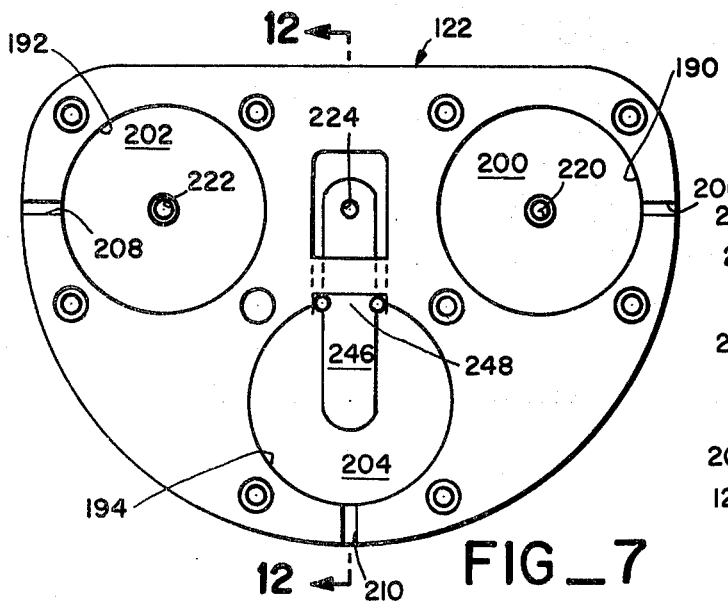
FIG. 7 is a plan view of the inside of the base of the self-contained system regulator and is taken along the line and in the direction indicated by the arrows 7—7 in FIG. 3 and FIG. 13.

As best shown in FIG. 6, each leaf spring 230 and 232 is pivoted on a pivot 236 of a deck member 238.

As best illustrated in FIG. 5, the end of the spring 230 has a slot 231 and the end of the spring 232 has a slot 233. These slots hook under discs 236 connected to the respective diaphragms 200 and 202. Adjustable set screws 240 and 242 are threaded within the top cover 120 so that turning the set screw 240 downward causes the leaf spring 230 to pull upward on the diaphragm 200 with greater force and turning the adjustable set screw 240 downward also increases the upward biasing force on the diaphragm 202.

The set screw 240 serves as a factory adjustment for changing the set point for the cold duct operation, and the set screw 242 serves as a field adjustment for selecting series or parallel operation of the reset duct when the reset duct is a reset cold duct.

A third set screw 244 is also threaded within the top cover 120. This set screw 244 serves as a ventilation set point adjustment.

As best illustrated in FIG. 12, turning the set screw 244 downward increases the compression of the coil spring 234. This, in turn, increases the downward biasing force that the spring 234 exerts on the end of a lever 246.

The lever 246 is pivoted on a pivot 248. One end of the lever 246 has a cap 250 which controls the bleed flow through the orifice 224. The other end of the lever 246 engages a disc 252 on the underside of the diaphragm 204.

The lever 246 thus reverses the effect of a pressure change in chamber 185 on the bleed flow through the orifice 224 as compared to a corresponding pressure changed in the chambers 181 and 183 on the bleed flow through the orifices 220 and 222.

Referring now to FIG. 13, the manner in which the hot-cold reset arm 130 and the bimetal 128 coact to select one of the orifices 222 and 224 for control of the flow through the reset duct will now be described.

The bimetal 128 is fixed at one end to a post 251 by a cap screw 252. The free end of the bimetal 128 is connected to a rod 256 which is vertically movable within a sealed opening 258 extending through the bimetal deck 126. The upper end 260 forms the point of force application for the hot-cold reset arm 130. The fulcrum 262 is formed integral with the base 122.

The hot-cold reset arm has a cap 264 at one end which controls the flow of air into the orifice 224 and has a cap 266 at the other end which controls flow of air into the orifice 222.

A biasing spring 268 is disposed between one end of the hot-cold reset arm 130 and the base 122 as illustrated.

The bimetal deck 126 forms a chamber 270 with the underside of the base 122. This chamber 270 is sealed except for the orifices 222 and 224 and a channel 272 connected to the reset duct control fitting 160.

The action of the bimetal 128 in response to the air temperature in the reset duct (as supplied through the reset duct temperature sensing fitting 142) determines which of the two orifices 222 and 224 is sealed off and which orifice is maintained open for control by a related diaphragm 202 or 204.

When the reset duct contains hot air the bimetal 128 swings downward at its free end (as viewed in FIG. 13) to move the point 260 downward. This moves the cap 264 off of the lower end of the orifice 224 so that the reset heating diaphragm 204 controls the bleed flow out of the orifice 224 (in response to the action of the thermostat 40 which regulates the pressure on top of the diaphragm 204). In this condition of operation the biasing spring 268 causes the hot-cold reset arm 130 to pivot to an angle in which cap 266 closes off the bottom of the orifice 222. The pressure in the chamber 270 is therefore regulated by the bleed flow through the orifice 224 and this regulated pressure is transmitted to the chamber **74*a* and the reset air duct actuator 46 by the conduit 162 shown in FIG. 3**.

When the reset air duct contains cold air, the action of the bimetal 128 raises the point 260 (as viewed in FIG. 13) to cap off the bottom side of the orifice 224 and to lower the cap 266 off of the bottom of the orifice 222 so that the diaphragm 204 then controls the bleed flow out of the orifice 22 and thus regulates the pressure in the chamber 270 and the conduit 162 and chamber 74*a* of the actuator 46 for the reset air duct.

FIGS. 14A, 14B and 14C show three distinct conditions of operation when the reset duct 33 is used as a hot duct. In each of these three conditions of operation the hot-cold reset arm 130 has closed off the bottom side of the orifice 222 so that only the orifice 224 can be effective to regulate the bleed flow of air from the chamber 270 of the self-contained system regulator 50 and the chamber 74*a* of the integrated sensor-actuator 46.

The condition of operation shown in FIG. 14A corresponds to the point indicated by the Roman numeral I in FIG. 15. In this condition of operation the cold duct control diaphragm 200 has moved full upward to provide a full bleed flow through the orifice 220 (in response to the full bleed flow from the nozzle 110 by the upward movement of the bimetal 112 in the thermostat 40) resulting from a low sensed room temperature calling for full heating. This full bleed flow through the orifice 220 reduces the pressure in the chamber 74 of the actuator 44 and therefore causes the valve 56 to move to a full closed position to block any cold air flow out of the cold air duct 31.

The pressure in the chamber 185 above the reset hot diaphragm 204 is the same as the pressure in the chamber 181 above the cold duct control diaphragm 200. However, this reduced pressure in the chamber 185 reverses the action of the control disc 250 on the orifice 224 as compared to the action of the control disc 221 on the orifice 220. This results from the action of the reversing lever 246 shown in FIG. 12 and described above. The control disc 250 therefore blocks off all bleed flow through the orifice 225 to cause the pressure in the chamber 270 of the self-contained system regulator 50 to build up to a maximum. This in turn creates the maximum pressure in chamber 74*a* of the actuator 46 to move the valve 56*a* full open and to permit maximum flow of hot air out of the volume control box 32.

FIG. 14C shows a mode of operation which is exactly opposite that of FIG. 14A. This mode of operation is indicated by the Roman numeral III on the graph of FIG. 15 and results from a room air temperature which calls for maximum cooling.

As the room temperature changes, to require either less heating than that provided by the FIG. 14A condition of operation of less cooling than that provided by the FIG. 14C condition of operation, the self-contained system regulator is effective to modulate the bleed flow out of a related orifice 220 or 224 while maintaining the other orifice closed. Thus, when less than maximum heating is required, the control cap 221 is normally maintained full off of the orifice 220 to maintain full bleed flow out of the orifice 220 and to thereby prevent any flow of cold air out of the cold air duct 31 while the control cap 250 is moved slightly off of the top of the orifice 224 to modulate the bleed flow through the orifice and to thereby regulate the position of the valve 56*a* to maintain the desired flow of hot air to provide the heating required to maintain the set point temperature.

Similarly, when some cooling, but not maximum cooling, is required the valve 56*a* of the reset hot duct is maintained full closed while the control cap 221 modulates the bleed flow thrugh the orifice 220 to position the valve 56 of the cold air duct 31 to provide sufficient cooling to maintain the selected set point temperature in the room.

A noted generally above the entire response line of the cooling air flow can be shifted (up or down the vertical axis as viewed in FIG. 15) by adjustment of the set screw 240. This kind of adjustment may be necessary to provide some minimum amount of mixing of air flow out of the reset hot duct and reset cold duct to maintain miminum ventilation requirements for a particular temperature set point of the thermostat 40.

A similar shifting of the response line for the reset hot duct can be obtained by a suitable adjustment of the ventilation set point adjustable set screw 244.

Roman numeral II in FIG. 115 illustrates a condition in which some slight overlap of the air flow out of the reset hot duct and cold air duct is produced (by adjustment of either one or both of the set screws 240 and 244). In this event both the control discs 221 and 250 are effective to modulate the bleed flow out of the orifices 220 and 224 at the same time, but only in the small area between the overlap to the left of Roman numeral II in FIG. 15.

FIGS. 14D and 14E, and the related graphs in the FIGS. 16 and 17, show two different conditions of operation in which the reset duct is a reset cold duct.

In each condition of operation of the hot-cold reset arm 130 has been positioned by the bimetal 128 to cap off the bottom of the orifice 224 so that modulation of the pressure in chamber 270 is obtained by controlled bleed flow through the orifice 222.

In the FIG. 14D condition of operation the seriesparallel adjustment set screw 242 has been positioned to provide the same bias on the reset cold duct control diaphragm 202 as the spring 230 exerts on the cold duct control diaphragm 200. Both diaphragms respond simultaneously and to the same extent to changes in room temperature as sensed by the thermostat 40, and the valves 56 and 56a in the two ducts are therefore positioned to produce parallel flow of cold air so that the room is provided with a combined total of the cold air from the two ducts on each increment of temperature change.

FIG. 14E shows the condition of operation in which the series-parallel adjustment screw 242 has been set to exert a bias on the reset cold duct control diaphragm 202, which is sufficiently greater than the bias exerted by the spring 230 on the cold duct control diaphragm 204 that the control valve 56*a* in the reset cold duct 33 does not start to open until the control valve 56 in the cold air duct 31 has been moved to a full open position.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A variable volume conditioned air distribution system for supplying a regulated volume of conditioned air to a room or other space and comprising, a first, cold duct for supplying cold air, a first movable member in the first, cold duct for regulating the volume of air flowing through the duct, a second, reset duct for supplying either hot air in a first mode of operation or cold air in a second mode of operation, a second movable member in the second, reset duct for regulating the volume of air flowing through the duct, and control means for positioning the first and second movable members in response to temperature in the room and effective to supply in sequence either a controlled variable volume of hot air from the reset duct alone on demand or a controlled variable volume of cold air from the cold duct alone on demand in the first mode of operation and effective to reverse the direction of response of the second movable member to temperature change in the second mode of operation from the direction of response of the second movable member to a similar temperature change in the first mode of operation so that the reset duct can be used as a hot duct with the system supplying either hot or cold air on demand in the heating season and as a cold duct to increase the cooling capacity of the system in the cooling season up to the total combined capacity of the first and second ducts.

2. The invention defined in claim 1 wherein the control means include first orifice means for controlling the position of the first movable member and second and third orifice means for controlling the position of the second movable member.

3. The invention defined in claim 2 including means for interlocking all three orifice means for response to a single room thermostat.

4. The invention defined in claim 2 including sequence means for controlling the sequence of operation of the first, second and third orifice means.

5. The invention defined in claim 1 wherein the control means are normally effective, in the first mode of operation, to supply conditioned air from only one of the cold the reset hot air ducts at a time without mixing with air from the other duct, but can be adjusted to provide a small overlap required to maintain minimum ventilation requirements.

6. A variable volume conditioned air distribution system for supplying a regulated volume of conditioned air to a room or other space and comprising, a first, cold duct for supplying cold air, a first movable member in the first, cold duct for regulating the volume of air flowing through the duct, a second, reset duct for supplying either hot air in a first mode of operation or cold air in a second mode of operation, a second movable member in the second, reset duct for regulating the volume of air flowing through the duct, and control means for positioning the first and second movable members in response to temperature in the room and effective to supply either a variable volume of hot air from the reset duct on demand or a variable volume of cold air from the cold duct on demand in the first mode of operation and effective to reverse the direction of response of the second movable member to temperature change in the second mode of operation from the direction of response of the second movable member to a similar temperature change in the first mode of operation so that the reset duct can be used as a hot duct with the system supplying either hot or cold air on demand in the heating season and as a cold duct to increase the cooling capacity of the system in the cooling season up to the total combined capacity of the first and second ducts and wherein the control means include first orifice means for controlling the position of the first movable member and second and third orifice means for controlling the position of the second movable member and include a bi-metal sensitive to the temperature of the air in the reset duct for selecting one of the second and third orifice means for control when the reset duct contains warm air and for selecting the other of the second and third orifice means for control when the reset duct contains cold air.

7. A variable volume conditioned air distribution system for supplying a regulated volume of conditioned air to a room or other space and comprising, a first, cold duct for supplying cold air, a first movable member in the first, cold duct for regulating the volume of air flowing through the duct, a second, reset duct for supplying either hot air in a first mode of operation or cold air in a second mode of operation, a second movable member in the second, reset duct for regulating the volume of air flowing through the duct, and control means for positioning the first and second movable members in response to temperature in the room and effective to supply either a variable volume of hot air from the reset duct on demand or a variable volume of cold air from the cold duct on demand in the first mode of operation and effective to reverse the direction of response of the second movable member to temperature change in the second mode of operation from the direction of response of the second movable member to a similar temperature change in the first mode of operation so that the reset duct can be used as a hot duct with the system supplying either hot or cold air on demand in the heating season and as a cold duct to increase the cooling capacity of the system in the cooling season up to the total combined capacity of the first and second ducts, and wherein the control means include first orifice means for controlling the position of the first movable member and second and third orifice means for controlling the position of the second movable member and including sequence means for controlling the sequence of operation of the first, second and third orifice means and wherein each orifice means includes a fixed diameter bleed flow opening, a cap movable toward and away from the opening to vary the bleed flow through the opening and a diaphragm for positioning the cap, and wherein the sequencing means include a spring for each diaphragm and an adjustable member for changing the biasing force exerted by the spring on the diaphragm.

8. A distribution system for supplying a regulated variable volume of conditioned air to a room or other space, and comprising, a first duct for supplying cold air, a first volume regulator means in the first duct for regulating the volume of air flowing through the first duct, a second duct for supplying hot air, a second volume regulator means in the second duct for regulating the volume of air flowing through the second duct, a room temperature sensor simultaneously controlling both volume regulators.

and control means for positioning the first and second volume regulator means in response to temperature in the room and effective to supply conditioned air from only one of the ducts at a time without mixing with air from the other duct, except for a possible small overlap required to maintain minimum ventilation requirements.

9. The invention defined in claim 8 wherein the second duct is a reset duct for supplying either hot air in a first mode of operation or cold air in a second mode of operation and wherein the control means are effective to reverse the direction of response of the second volume regulator means to temperature change in the second mode of operation from the direction of response to a similar temperature change in the first mode of operation so that the reset duct can be used as a hot duct with the system supplying hot or cold air on demand in the heating season and as a cold duct to increase the cooling capacity of the system in the cooling season up to the total combined capacity of the first and second ducts.

10. The invention defined in claim 8 wherein the first volume regulator means include a first pneumatically powered actuator and the second volume regulator means include a second pneumatically powered actuator.

11. The invention defined in claim 10 wherein each pneumatically powered actuator includes diaphragm means for using the differential between the total and static pressures in a related duct to position each volume regulator means in response to flow velocity in the related duct.

12. The invention defined in claim 10 wherein the control means include first orifice means for varying a pressure in the first actuator in response to changes in room temperature and second orifice means for varying a pressure in the second actuator in response to changes in room temperature and including reversing means for reversing the response of the second orifice means with respect to the response of the first orifice means and adjustable means for the orifice means which are adjustable to prevent said mixing of air flow from the two ducts.

13. The invention defined in claim 11 wherein the first and second pneumatically powered actuators are self-contained actuators and are powered by the differential between the total and static pressures in the duct without a relay.

14. A method of coordinating the control of air flow through a cold duct with the control of air flow through a reset duct so that the reset duct can be used to supply either hot air for heating in one mode of operation or cold air for increased cooling in a second mode of operation, said method comprising, measuring the air flow velocity in the cold duct, positioning a first movable member in the cold duct in response to the measured air flow velocity in the cold duct for regulating the volume of air flowing through the duct, measuring the air flow velocity in the reset duct, positioning a second movable member in the reset duct in response to the measured air flow velocity in the reset duct for regulating the volume of air flowing through the duct, changing said air flow velocity responsive positioning of the first and second movable members in response to changes in the temperature in the room, and reversing the direction of response of the second movable member to temperature change in the second mode of operation from the direction of response of the second movable member to a similar temperature change in the first mode of operation so that the reset duct can be used as a hot duct with the system supplying hot or cold air on demand in the heating season and as a cold duct to double the cooling capacity of the system in the cooling season.

15. The invention defined in claim 14 including sensing the temperature of the air in the reset duct and performing said reversing step in response to a change of air temperature in the reset duct between hot air and cold air.

16. A method of controlling the flow of air in a dual duct, variable volume conditioned air distribution system by coordinating the control of air flow through a cold duct with the control of air flow through a reset duct so that the reset duct can be used to supply either hot air for heating in a first mode of operation or cold air for increased cooling in a second mode of operation, said method comprising, positioning a first movable member in the cold duct for regulating the volume of air flowing through the duct, positioning a second movable member in the reset duct for regulating the volume of air flowing through the duct, controlling the positioning of the first and second movable members in response to the temperature in the room, supplying, in said first mode of operation, conditioned air from only one of the cold and reset hot air ducts at a time without mixing with air from the other duct, except for a possible small overlap required to maintain minimum ventilation requirements, and reversing the direction of response of the second movable member to temperature change in the second mode of operation from the direction of response of the second movable member to a similar temperature change in the first mode of operation so that the reset duct can be used as a hot duct with the system supplying hot or cold air on demand in the heating season and as a cold duct to increase the cooling capacity of the system in the cooling season up to the total combined capacity of the cold and reset ducts.

17. A method of controlling the flow of air in a dual duct, variable volume conditioned air distribution system by coordinating the control of air flow through a cold duct with the control of the air flow through a reset duct so that the reset duct can be used to supply either hot air for heating in a first mode of operation or cold air for increased cooling in a second mode of operation, said method comprising, positioning a first movable member in the cold duct for regulating the volume of air flowing through the duct, positioning a second movable member in the reset duct for regulating the volume of air flowing through the duct, controlling the positioning of the first and second movable members in response to the temperature in the room, and supplying, in said first mode of operation, conditioned air from only one of the cold and reset hot air ducts at a time without mixing with air from the other duct, except for a possible small overlap required to maintain minimum ventilation requirements.

18. A dual duct, variable volume, conditioned air distribution system for supplying a regulated volume of conditioned air to a room or other space, and comprising, a first duct for supplying cold air, a first volume regulator means in the first duct for regulating the volume of air flowing through the first duct, a second, reset duct for supplying either hot air in a first mode of operation or cold air in a second mode of operation, a second volume regulator means in the second, reset duct for regulating the volume of air flowing through the second duct, and control means for positioning the first and second volume regulator means in response to temperature in the room and effective in the first mode of operation to supply a controlled variable volume of conditioned air from only one of the hot and cold air ducts at a time without mixing with air from the other duct, except for a possible small overlap required to maintain minimum ventilation requirements, and also effective to reverse the direction of response of the second volume regulator means to temperature change in the second mode of operation from the direction of response to a similar temperature change in the first mode of operation so that the reset duct can be used as a hot duct with the system supplying hot or cold air on demand in the heating season and as a cold duct to increase the cooling capacity of the system in the cooling season up to the total combined capacity of the first and second ducts.

19. A conditioned air distribution system for supplying a regulated volume of conditioned air to a room or other space and comprising, a reset duct for supplying either hot air in a first mode of operation or cold air in a second mode of operation, a movable member in the reset duct for regulating the volume of air flowing through the duct, an actuator for positioning the movable member, air flow velocity sensing means for measuring the air flow velocity in the reset duct and operatively associated with the actuator for positioning the movable member in response to the measured air flow velocity in said reset duct, and control means operatively associated with the air flow velocity sensing means and the actuator for overriding the air flow velocity control of the actuator to position the movable member in response to temperature in the room and effective to reverse the direction of response of the actuator to a temperature change in the second mode of operation from the direction of response of the actuator to a similar temperature change in the first mode of operation while retaining the positioning of said movable member in response to the measured air flow velocity in the reset duct as sensed by said air flow velocity sensing means so that the reset duct can be used as a hot duct with the system supplying hot air on demand in the heating season and as a cold duct to supply cold air on demand in the cooling season.

20. The invention defined in claim 19 wherein the control means include first and second orifice means for controlling the position of the movable member.

21. The invention defined in claim 19 wherein said control means include a temperature responsive element sensitive to the temperature of the air in the reset duct for reversing the direction of response of the actuator in response to a change of air temperature in said reset duct between hot air and cold air.

22. A conditioned air distribution system for supplying a regulated volume of conditioned air to a room or other space and comprising, a reset duct for supplying either hot air in a first mode of operation or cold air in a second mode of operation, a movable member in the reset duct for regulating the volume of air flowing through the duct, an acutator for positioning the movable member, and control means for controlling the actuator to position the movable member in response to temperature in the room and effective to reverse the direction of response of the actuator to temperature change in the second mode of operation from the direction of response of the actuator to a similar temperature change in the first mode of operation so that the reset duct can be used as a hot duct with the system supplying hot air on demand in the heating season and as a cold duct to supply cold air on demand in the cooling season wherein the control means include first and second orifice means for controlling the position of the movable member, and a thermo-responsive element sensitive to the temperature of the air in the reset duct for selecting one of the first and second orifice means for control when the reset duct contains warm air and for selecting the other of the first and second orifice means for control when the reset duct contains cold air.

23. A conditioned air distribution system for supplying a regulated volume of conditioned air to a room or other space and comprising, a reset duct for supplying either hot air in a first mode of operation or cold air in a second mode of operation, a movable member in the reset duct for regulating the volume of air flowing through the duct, an actuator for positioning the movable member, and control means for controlling the actuator to position the movable member in response to temperature in the room and effective to reverse the direction of response of the actuator to temperature change in the second mode of operation from the direction of response of the actuator to a similar temperature change in the first mode of operation so that the reset duct can be used as a hot duct with the system supplying hot air on demand in the heating season and as a cold duct to supply cold air on demand in the cooling season and wherein the control means include first and second orifice means for controlling the position of the movable member and including sequence and set point means for controlling the sequence and set points of operation of the first and second orifice means.

24. The invention defined in claim 23 wherein each orifice means includes a fixed diameter bleed flow opening, a cap movable toward and away from the opening to vary the bleed flow through the opening and a diaphragm for positioning the cap, and wherein the sequencing means include a spring for each diaphragm and an adjustable member for changing the biasing force exerted by the spring on the diaphragm.

25. A method of coordinating the control of air flow through a reset duct so that the reset duct can be used to supply either hot air for heating in one mode of operation or cold air for cooling in a second mode of operation, said method comprising, measuring the air flow velocity in the reset duct, positioning a movable member in the reset duct in response to the measured air flow velocity in the reset duct for regulating the volume of air flowing through the duct, changing said air flow velocity positioning of the movable member in response to the temperature in the room, and reversing the direction of response of the actuator to temperature change in the second mode of operation from the direction of response of the actuator to a similar temperature change in the first mode of operation while retaining the positioning of said movable member in response to the measured air flow velocity in the reset duct so that the reset duct can be used as a hot duct with the system supplying hot air on demand in the heating season and as a cold duct to supply cold air on demand in the cooling season.

26. A variable volume conditioned air distribution system for supplying a regulated volume of conditioning air to a room or other space and comprising, a first cold duct for supplying cold air, a first movable member in the first cold duct for regulating the volume of air flowing through the duct, first actuator means for moving the first movable member, first air flow velocity sensing means for sensing the air flow velocity in the first duct and operatively associated with the first actuator means for moving the first movable member in response to changes in the air flow velocity in said first duct, a second reset duct for supplying either hot air in a first mode of operation or cold air in a second mode of operation, a second movable member in the second reset duct for regulating the volume of air flowing through the duct, second actuator means for moving the second movable member, second air flow velocity sensing means for sensing the air flow velocity in the second duct and operatively associated with the second actuator means for moving the second movable member in response to changes in the air flow velocity in said second duct, and control means operatively associated with the first and second air flow velocity sensing means and the first and second actuator means for positioning the first and second movable members in response to temperature in the room and effective to supply in sequence either a controlled variable volume of hot air from the reset duct on demand or a controlled variable volume of cold air from the cold duct on demand in the first mode of operation and effective to reverse the direction of response of the second movable member to temperature change in the second mode of operation from the direction of response of the second movable member to a similar temperature change in the first mode of operation so that the reset duct can be used as a hot duct with the system supplying either hot or cold air on demand in the heating system and as a cold duct to increase the cooling capacity of the system in the cooling season up to the total combined capacity of the first and second ducts.

27. A distribution system for supplying a regulated variable volume of conditioned air to a room or other space, and comprising, a first duct for supplying cold air, a first volume regulator means including a first movable member in the first duct for regulating the volume of air flowing through the first duct, first air flow velocity sensing means for sensing the air flow velocity in the first duct and operatively associated with the first volume regulator means for moving the first movable member in response to changes in the air flow velocity in said first duct, a second duct for supplying hot air, a second volume regulator means including a second movable member in the second duct for regulating the volume of air flowing through the second duct, second air flow velocity sensing means for sensing the air flow velocity in the second duct and operatively associated with the second volume regulator means for moving the second movable member in response to changes in the air flow velocity in said second duct, and control means operatively associated with the first and second air flow velocity sensing means and the first and second volume regulator means for positioning the first and second volume regulator means in response to temperature in the room and effective to supply conditioned air from only one of the ducts at a time without mixing with air from the other duct, except for a possible small overlap required to maintain minimum ventilation requirements.

28. The invention defined in claim 27 including means for adjusting the amount of said overlap.

29. A method of controlling the flow of air in a dual duct, variable volume conditioned air distribution system by coordinating the control of air flow through a cold duct with the control of air flow through a reset duct so that the reset duct can be used to supply either hot air for heating in a first mode of operation or cold air for increased cooling in a second mode of operation, said method comprising, measuring the air flow velocity in the cold duct, positioning a first movable member in the cold duct in response to the measured air flow velocity in the cold duct for regulating the volume of air flowing through the duct, measuring the air flow velocity in the reset duct, positioning a second movable member in the reset duct in response to the measured air flow velocity in the reset duct for regulating the volume of air flowing through the duct, changing said air flow velocity responsive positioning of the first and second movable members in response to changes in the temperature in the room, and supplying, in said first mode of operation, conditioned air from only one of the cold and reset hot air ducts at a time without mixing with air from the other duct, except for a possible small overlap required to maintain minimum ventilation requirements, and reversing the direction of response of the second movable member to temperature change in the second mode of operation from the direction of response of the second movable member to a similar temperature change in the first mode of operation so that the reset duct can be used as a hot duct with the system supplying hot or cold air on demand in the heating season and as a cold duct to increase the cooling capacity of the system in the cooling season up to the total combined capacity of the cold and reset ducts.

30. A method of controlling the flow of air in a dual duct, variable volume conditioned air distribution system by coordinating the control of air flow through a cold duct with the control of air flow through a reset duct so that the reset duct can be used to supply either hot air for heating in a first mode of operation or cold air for increased cooling in a second mode of operation, said method comprising, measuring the air flow velocity in the cold duct, positioning a first movable member in the cold duct in response to the measured air flow velocity in the cold duct for regulating the volume of air flowing through the duct, measuring the air flow velocity in the reset duct, positioning a second movable member in the reset duct in response to the measured air flow velocity in the reset duct for regulating the volume of air flowing through the duct, changing said air flow velocity responsive positioning of the first and second movable members in response to changes in the temperature in the room, and supplying, in said first mode of operation, conditioned air from only one of the cold and reset hot air ducts at a time without mixing with air from the other duct, except for a possible small overlap required to maintain minimum ventilation requirements.

31. A dual duct, variable volume, conditioned air distribution system for supplying a regulated volume of conditioned air to a room or other space, and comprising, a first duct for supplying cold air, a first volume regulator means including a first movable member in the first duct for regulating the volume of air flowing through the first duct, first air flow velocity sensing means for sensing the air flow velocity in the first duct and operatively associated with the first volume regulator means for moving the first movable member in response to changes in the air flow velocity in said first duct, a second reset duct for supplying either hot air in a first mode of operation or cold air in a second mode of operation, a second volume regulator means including a second movable member in the second reset duct for regulating the volume of air flowing through the second duct, second air flow velocity sensing means for sensing the air flow velocity in the second duct and operatively associated with the second volume regulator means for moving the second movable member in response to changes in the air flow velocity in said second duct, control means operatively associated with the first and second air flow velocity sensing means and the first and second volume regulator means for positioning the first and second volume regulator means in response to temperature in the room and effective in the first mode of operation to supply conditioned air from only one of the hot and cold air ducts at a time without mixing with air from the other duct, except for a possible small overlap required to maintain minimum ventilation requirements, and also effective to reverse the direction of response of the second volume regulator means to temperature change in the second mode of operation from the direction of response to a similar temperature change in the first mode of operation so that the reset duct can be used as a hot duct with the system supplying hot or cold air on demand in the heating season and as a cold duct to increase the cooling capacity of the system in the cooling season up to the total combined capacity of the first and second ducts.

* * * * *